US010024031B2

(12) United States Patent
Yanagisawa

(10) Patent No.: US 10,024,031 B2
(45) Date of Patent: Jul. 17, 2018

(54) SHOVEL

(71) Applicant: Sumitomo Heavy Industries, Ltd., Tokyo (JP)

(72) Inventor: Makoto Yanagisawa, Chiba (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 13 days.

(21) Appl. No.: 14/664,133

(22) Filed: Mar. 20, 2015

(65) Prior Publication Data

US 2015/0275478 A1 Oct. 1, 2015

(30) Foreign Application Priority Data

Mar. 31, 2014 (JP) ..... 2014-074741

(51) Int. Cl.

| | |
|---|---|
| ***E02F 9/12*** | (2006.01) |
| ***E02F 3/32*** | (2006.01) |
| ***E02F 3/36*** | (2006.01) |
| ***E02F 9/20*** | (2006.01) |
| ***E02F 9/22*** | (2006.01) |
| ***E02F 9/26*** | (2006.01) |

(52) U.S. Cl.

CPC ..... *E02F 9/128* (2013.01); *E02F 3/32* (2013.01); *E02F 3/36* (2013.01); *E02F 9/123* (2013.01); *E02F 9/2025* (2013.01); *E02F 9/2037* (2013.01); *E02F 9/2075* (2013.01); *E02F 9/2091* (2013.01); *E02F 9/2095* (2013.01); *E02F 9/2285* (2013.01); *E02F 9/265* (2013.01)

(58) Field of Classification Search

CPC ..... E02F 9/2083; E02F 9/226; E02F 9/2246; E02F 9/24; E02F 9/123; E02F 9/125; E02F 9/128; B60W 20/50

See application file for complete search history.

(56) References Cited

U.S. PATENT DOCUMENTS

| | | | | |
|---|---|---|---|---|
| 4,792,052 A * | 12/1988 | Okuda | B60K 28/04 | 123/198 D |
| 5,967,758 A * | 10/1999 | Fujii | E02F 9/2025 | 417/12 |
| 5,974,796 A * | 11/1999 | Ishikawa | E02F 9/2225 | 60/399 |
| 8,479,848 B2 | 7/2013 | Yanagisawa | | |
| 2004/0178673 A1* | 9/2004 | Magnien | B60T 13/585 | 303/11 |

(Continued)

FOREIGN PATENT DOCUMENTS

JP 2012-157136 A 8/2012

*Primary Examiner* — John Olszewski
*Assistant Examiner* — Thomas E Worden
(74) *Attorney, Agent, or Firm* — Fenwick & West LLP

(57) ABSTRACT

A shovel includes a lower traveling body; an upper swivel body that is mounted on the lower traveling body; an electric motor for swiveling that drives the upper swivel body in a swiveling manner; a mechanical brake that holds a swiveling stopped state of the upper swivel body; an engine; a hydraulic pump that discharges hydraulic oil with the power of the engine; a hydraulic actuator that is driven by the hydraulic oil discharged by the hydraulic pump; a pressure detecting unit that detects the discharge pressure of the hydraulic pump; and a control device that controls the mechanical brake on the basis of information on the discharge pressure detected by the pressure detecting unit.

10 Claims, 6 Drawing Sheets

(56) References Cited

U.S. PATENT DOCUMENTS

| | | | | |
|---|---|---|---|---|
| 2007/0186451 | A1* | 8/2007 | Yoshimatsu | E02F 9/128 37/348 |
| 2007/0273316 | A1* | 11/2007 | Yoshimatsu | E02F 9/121 318/371 |
| 2010/0043419 | A1* | 2/2010 | Nomura | B60K 17/10 60/328 |
| 2010/0064677 | A1* | 3/2010 | Kawaguchi | E02F 9/2075 60/431 |
| 2010/0270854 | A1* | 10/2010 | Okano | B60T 1/10 303/3 |
| 2013/0218428 | A1* | 8/2013 | Onodera | F16H 61/421 701/54 |
| 2013/0289834 | A1* | 10/2013 | Park | F02D 41/021 701/50 |
| 2013/0297168 | A1* | 11/2013 | Svensson | B60T 8/1755 701/70 |
| 2015/0259879 | A1* | 9/2015 | Ono | E02F 9/2075 701/50 |

* cited by examiner

FIG. 5

| | SMALL DISCHARGE PRESSURE | | SMALL DISCHARGE PRESSURE FLUCTUATION | | (REFER) LARGE DISCHARGE PRESSURE AND LARGE DISCHARGE PRESSURE FLUCTUATION |
|---|---|---|---|---|---|
| | SCRAPING OPERATION | HORIZONTAL PULLING AND LEVELING OPERATION | HYDRAULIC OIL WARM-UP OPERATION | DIRECTION CHANGE OPERATION | EXCAVATION OPERATION |
| BOOM CYLINDER | × | ○ (LIGHT LOAD) | × | × | ○ (HIGH LOAD) |
| ARM CYLINDER | × | ○ (LIGHT LOAD) | × | × | ○ (HIGH LOAD) |
| BUCKET CYLINDER | × | ○ (LIGHT LOAD) | ○ (HIGH LOAD) | × | ○ (HIGH LOAD) |
| TRAVELING HYDRAULIC MOTOR (RIGHT) | × | × | × | ○ (HIGH LOAD) | × |
| TRAVELING HYDRAULIC MOTOR (LEFT) | ○ (LIGHT LOAD) | × | × | × | × |

SHOVEL

RELATED APPLICATIONS

Priority is claimed to Japanese Patent Application No. 2014-074741, filed Mar. 31, 2014, the entire content of which is incorporated herein by reference.

BACKGROUND

Technical Field

A certain embodiment of the invention relates to a shovel.

Description of Related Art

Shovels having an electrically powered swiveling mechanism are known in the related art.

In the related art, there is disclosed a shovel which has mounted thereon an electric motor for swiveling for driving power storage system including a power storage, a DC bus and a converter, and a swiveling mechanism, drives the electric motor for swiveling with the electric power supplied from the power storage system, and realizes swiveling manipulation.

SUMMARY

According to an embodiment of the present invention, there is provided a shovel includes a lower traveling body; an upper swivel body that is mounted on the lower traveling body; an electric motor for swiveling that drives the upper swivel body in a swiveling manner; a mechanical brake that holds a swiveling stopped state of the upper swivel body; an engine; a hydraulic pump that discharges hydraulic oil with the power of the engine; a hydraulic actuator that is driven by the hydraulic oil discharged by the hydraulic pump; a pressure detecting unit that detects the discharge pressure of the hydraulic pump; and a control device that controls the mechanical brake on the basis of information on the discharge pressure detected by the pressure detecting unit.

BRIEF DESCRIPTION OF THE DRAWINGS

FIG. 5 is a table illustrating operation examples of the hybrid shovel capable of holding a swiveling stopped state of an upper swivel body by a mechanical brake, and drive states of hydraulic actuators in the respective operation examples.

DETAILED DESCRIPTION

In the shovels in which the swiveling mechanism is electrically powered, servo control (servo lock control) of a mechanical brake and the electric motor for swiveling is used as means for holding (positionally fixing) a stopped state of a swivel body when the swiveling manipulation is not performed. The mechanical brake brings a brake disk rotatably provided integrally with a rotating shaft of the swivel body and a brake plate provided in a fixing portion into surface contact with each other, thereby generating a frictional force to hold the stopped state of the swivel body. Additionally, the servo lock control performs speed control with a speed command as 0, and holds the stopped state of the swivel body.

As described above, since the mechanical brake holds the stopped state of the swivel body with the frictional force, when a large external force may act on the swivel body, the stopped state of the swivel body is generally held through the servo lock control of the electric motor for swiveling in order to prevent wear of the mechanical brake. Specifically, when the manipulation of the boom, the arm, the bucket, and the like of the shovel is performed, or when the manipulation of a traveling body of the shovel is performed, generally, the stopped state of the swivel body is held through the servo lock control of the electric motor for swiveling, assuming that a large external force may act on the swivel body.

However, the servo lock control of the electric motor for swiveling requires supply of electric power from the power storage in order to generate a holding torque, and there is a concern that energy loss is large and fuel consumption may deteriorate, unlike the mechanical brake.

Additionally, when the swivel body is held through the servo lock control of the electric motor for swiveling, a situation where a large holding torque should continue being applied is assumed, and there is also a concern that the electric motor for swiveling may be overloaded.

Thus, it is desirable to provide a shovel capable of holding a stopped state of a swivel body by a mechanical brake according to its own operation situation.

According to the embodiment of the invention, it is possible to increase an aspect in which the mechanical brake is used while preventing wear of the mechanical brake, thereby achieving overload prevention and energy saving of the electric motor for swiveling.

Hereinafter, embodiments for carrying out inventing will be described with reference to the drawings.

Figure 1:
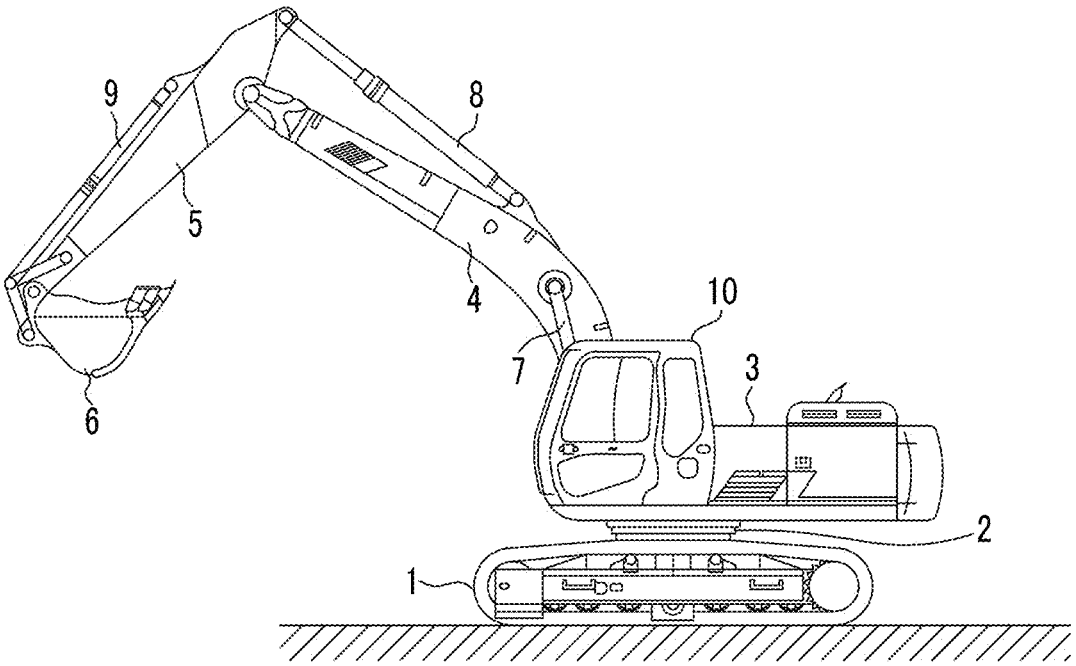
FIG. 1 is a side view of a hybrid shovel related to an embodiment.

First, the overall configuration of a hybrid shovel and the configuration of a drive system related to an embodiment of the invention will be described. FIG. 1 is a side view illustrating a shovel related to the embodiment.

An upper swivel body 3 as a work element is mounted on a lower traveling body 1 of the hybrid shovel illustrated in FIG. 1 via a swiveling mechanism 2. The boom 4 is attached to the upper swivel body 3. An arm 5 is attached to a tip of the boom 4, and a bucket 6 is attached to a tip of the arm 5. The boom 4, the arm 5, and the bucket 6 serving as attachments are hydraulically driven by a boom cylinder 7, an arm cylinder 8, and a bucket cylinder 9, respectively, which serve as actuators. Additionally, the upper swivel body 3 is provided with a cabin 10, and is mounted with power sources, such as an engine.

Figure 2:
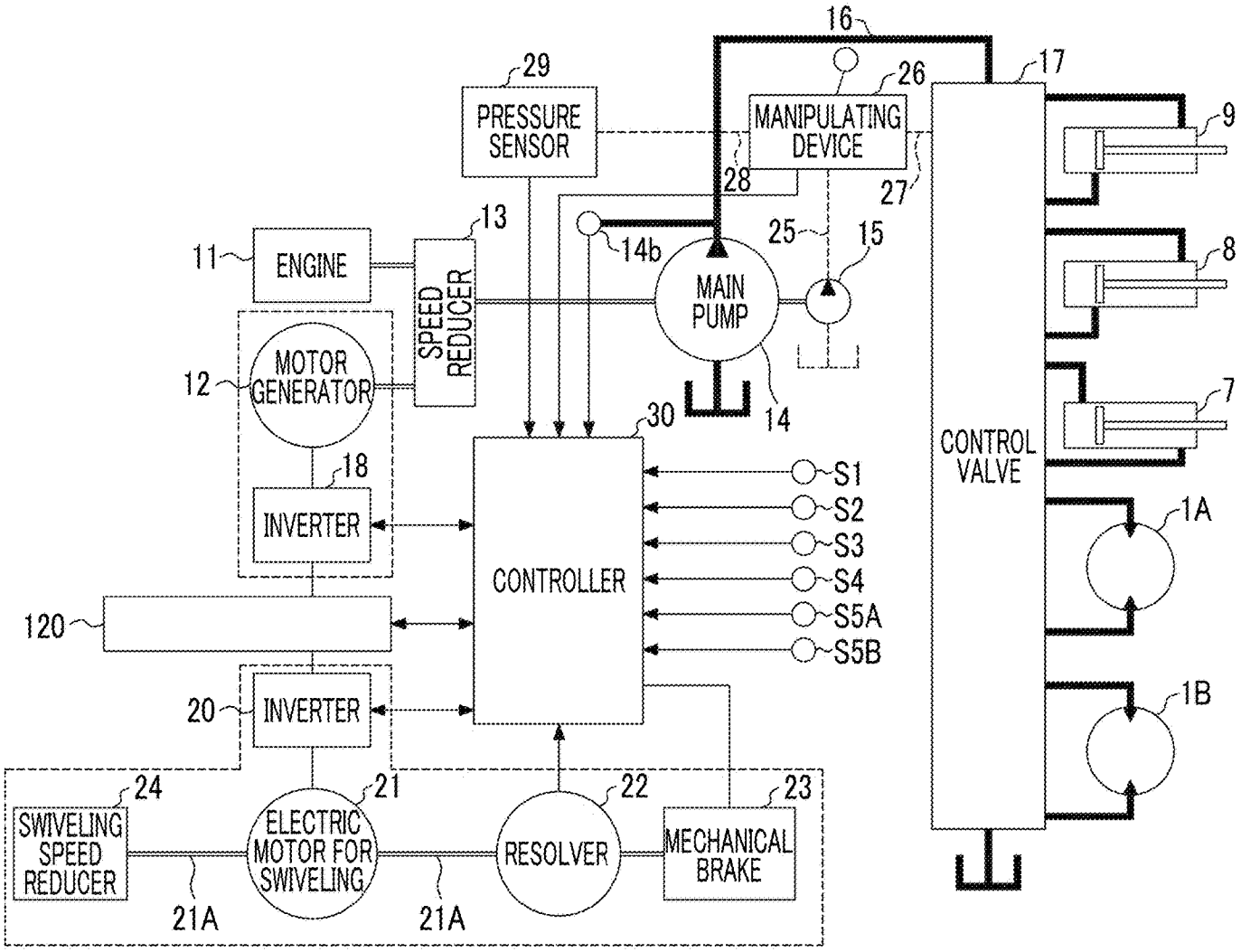
FIG. 2 is a block diagram illustrating an example of the configuration of a drive system of the hybrid shovel.

FIG. 2 is a block diagram illustrating the configuration of the drive system of the hybrid shovel illustrated in FIG. 1. In FIG. 2, a mechanical power system is illustrated by double lines, high-pressure hydraulic lines are illustrated by thick solid lines, pilot lines are illustrated by dashed lines, and an electrical drive/control system is illustrated by thin solid lines.

An engine 11 and a motor generator 12 serving as an assist motor are respectively connected to two input shafts of a speed reducer 13. A main pump 14 and a pilot pump 15 are connected to an output shaft of the speed reducer 13 serving as a hydraulic pump. A control valve 17 is connected to the main pump 14 via a high-pressure hydraulic line 16. Additionally, a manipulating device 26 is connected to the pilot pump 15 via the pilot line 25. In addition, a power storage system 120 including a power storage device is connected to the motor generator 12 via an inverter 18.

The main pump 14 is a hydraulic pump that supplies hydraulic oil to the control valve 17 via the high-pressure hydraulic line 16, for example, is a swash plate type variable-displacement hydraulic pump. The main pump 14 can change the angle (tilt angle) of a swash plate, thereby adjusting the stroke length of a piston and changing a discharge flow rate, that is, pump output. The swash plate of the main pump 14 is controlled by a regulator (not illustrated). The regulator changes the tilt angle of the swash plate corresponding to a change in a control current for an electromagnetic proportional valve (not illustrated). For example, by decreasing the control current, the regulator makes the tilt angle of the swash plate large to decrease the discharge flow rate of the main pump 14. For example, by increasing the control current, the regulator enlarges the tilt angle of the swash plate to increase the discharge flow rate of the main pump 14. In addition, the high-pressure hydraulic line 16 immediately after the main pump 14 is provided with a discharge pressure sensor 14*b* that detects the discharge pressure of the main pump 14, and a signal (discharge pressure signal) corresponding to the discharge pressure is output to a controller 30.

The pilot pump 15 is a hydraulic pump for supplying hydraulic oil to various oil-pressure-control instruments via the pilot line 25, for example, is a fixed-displacement hydraulic pump.

The control valve 17 is a hydraulic control device that controls a hydraulic system in the hybrid shovel. Various actuators, such as a hydraulic motor 1A (for the right) and a hydraulic motor 1B (for the left) for the lower traveling body 1, the boom cylinder 7, the arm cylinder 8, and the bucket cylinder 9, are connected to the control valve 17 via the high-pressure hydraulic lines. In addition, in the following description, the hydraulic motor 1A (for the right), the hydraulic motor 1B (for the left), the boom cylinder 7, the arm cylinder 8, and the bucket cylinder 9 may be collectively referred to as "hydraulic actuators".

The manipulating device 26 is manipulating means for manipulating various actuators (hydraulic actuators and an electric motor 21 for swiveling that serves as an electric actuator to be described below), and generates a pilot pressure according to the contents of manipulation, such as a manipulated variable and a manipulation direction. Additionally, the manipulating device 26 is connected to the control valve 17 and a pressure sensor 29, respectively, via hydraulic lines 27 and 28. The pressure sensor 29 converts the pilot pressure generated by the manipulating device 26 into an electrical signal, and outputs the converted electrical signal to the controller 30 to be described below. The manipulating device 26 includes levers 26A and 26B, and a pedal 26C. For example, the manipulation of the swiveling mechanism 2 (electric motor 21 for swiveling to be described below), the boom 4 (boom cylinder 7), the arm 5 (arm cylinder 8), and the bucket 6 (bucket cylinder 9) may be performed by the levers 26A and 26B. Additionally, the manipulation of the lower traveling body 1 (hydraulic motors 1A and 1B) may be performed by the pedal 26C. The control valve 17 actuates spool valves corresponding to various actuators (respective hydraulic actuators) according to the pilot pressure generated by the manipulating device 26 (the levers 26A and 26B and the pedal 26C), and supplies the hydraulic oil discharged by the main pump 14 to the various actuators.

The hybrid shovel illustrated in FIG. 2 is provided by making the swiveling mechanism electrically powered, and has the electric motor 21 for swiveling that serves as a swiveling motor in order to drive the swiveling mechanism 2. The electric motor 21 for swiveling that serves as an electric actuator is connected to the power storage system 120 via an inverter 20. A resolver 22, a mechanical brake 23, and a swiveling speed reducer 24 are connected to a rotating shaft 21A of the electric motor 21 for swiveling.

The mechanical brake 23 is a mechanical braking device, mechanically stops the rotating shaft 21A of the electric motor 21 for swiveling, and holds the stopped state of the upper swivel body 3. The mechanical brake 23 includes, for example, a brake disk that is rotatably provided integrally with the rotating shaft 21A, and a brake plate that is provided in a fixing portion, and may generate a frictional force as a braking force due to the surface contact between the brake disk and the brake plate. Switching control between the actuation or release of the mechanical brake 23 is performed by the controller 30.

Figure 3:
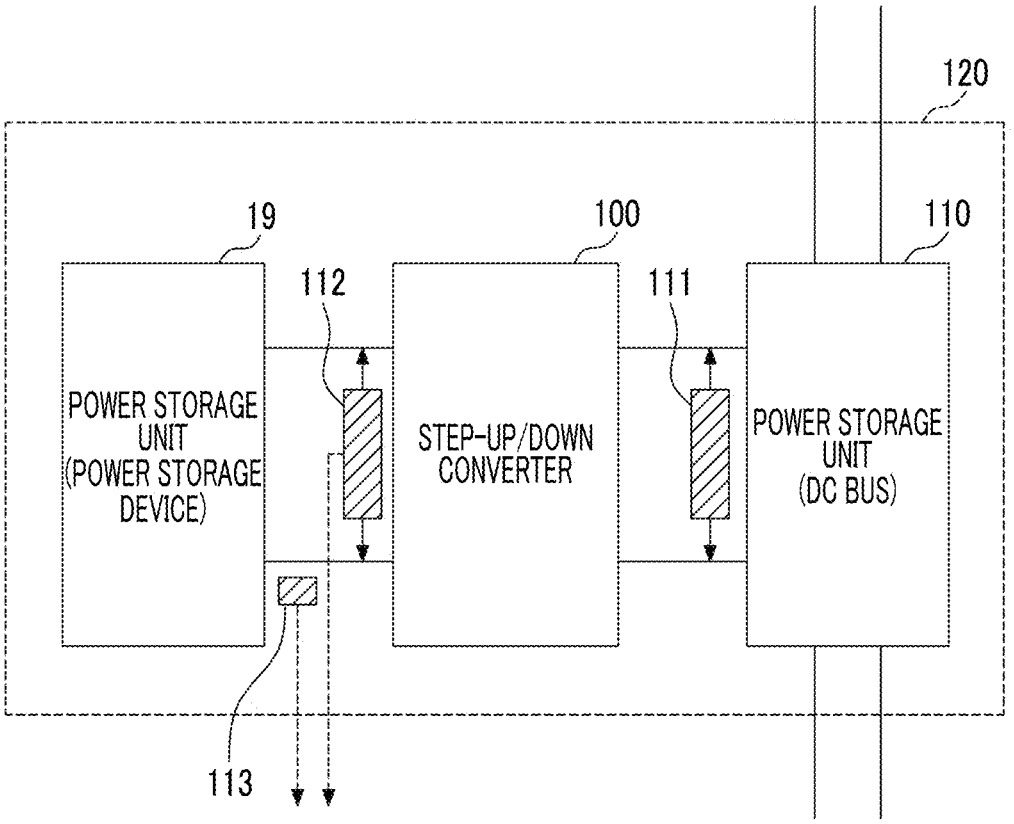
FIG. 3 is a block diagram illustrating an example of the configuration of a power storage system of the hybrid shovel.

FIG. 3 is a block diagram illustrating an example of the configuration of the power storage system 120 illustrated in FIG. 2. The power storage system 120 includes a power storage device 19 serving as a power storage unit, a step-up/down converter 100, and a DC bus 110 serving as a separate power storage unit. In the present embodiment, the power storage device 19 is, for example, a capacitor. Additionally, the DC bus 110 controls transfer of electric power between the motor generator 12, the power storage device 19, and the electric motor 21 for swiveling. Additionally, the capacitor 19 serving as a power storage device is provided with a capacitor voltage detecting unit 112 for detecting a capacitor voltage value and a capacitor current detecting unit 113 for detecting a capacitor current value. The capacitor voltage value and the capacitor current value detected by the capacitor voltage detecting unit 112 and the capacitor current detecting unit 113 are supplied to the controller 30 to be described below.

The step-up/down converter 100 switches a step-up operation and a step-down operation according to the operational state of the motor generator 12 and the electric motor 21 for swiveling so that the DC bus voltage falls within in a certain range. In the present embodiment, the step-up/down converter 100 is arranged between the capacitor 19 and the DC bus 110. Additionally, the DC bus 110 is arranged between the inverters 18 and 20 and the step-up/down converter 100, and transfer of electric power is performed between the motor generator 12, the capacitor 19, and the electric motor 21 for swiveling.

Returning to FIG. 2, the hybrid shovel related to the present embodiment has the controller 30 for controlling the drive control of the shovel. The controller 30 may be, for example, an arithmetic processing unit including a central processing unit (CPU) and an internal memory. Specifically, the controller 30 makes the CPU execute a drive control program stored in the internal memory so as to realize various functions.

For example, the controller 30 performs switching between an electrically power-assisted operation and a power-generating operation through the drive control of the motor generator 12. Additionally, the controller 30 performs the drive control of the step-up/down converter 100 serving as a step-up/down control unit. More specifically, charge/discharge control of the capacitor 19 is performed through the switching control between the step-up operation and the step-down operation of the step-up/down converter based on the charge state of the capacitor 19 serving as a power storage device, the operational state of the motor generator 12, or the like. In addition, the step-up operation is the operation of moving the electrical energy of the capacitor to the DC bus 110 so as to raise the voltage of the DC bus 110, and the step-down operation is the operation of moving the electrical energy of the DC bus 110 to the capacitor 19 so as to drop the voltage of the DC bus 110. Additionally, the operational state of the motor generator 12 includes an electrically power-assisted operation state and a power-generating operation state, and the operational state of the electric motor 21 for swiveling includes a power operation state and a regenerative operation state.

The switching control between the step-up operation and the step-down operation of the step-up/down converter 100 is performed on the basis of a DC bus voltage value detected by the DC bus voltage detecting unit 111, the capacitor voltage value detected by the capacitor voltage detecting unit 112, and the capacitor current value detected by the capacitor current detecting unit 113.

Additionally, the controller 30 converts a signal supplied from the pressure sensor 29 into a speed command, and performs the drive control of the electric motor 21 for swiveling. In addition, a signal supplied from the pressure sensor 29 is equivalent to a signal showing the content of manipulation when the manipulating device 26 is manipulated in order to swivel the swiveling mechanism 2. For example, the feedback control of feeding back a detection value of the rotating speed of the electric motor 21 for swiveling input from the resolver 22 may be executed with respect to the speed command. Then, the controller 30 may generate a command (torque command) for the torque which the electric motor 21 for swiveling is made to generate through the feedback control, and drive the inverter 20 according to the torque command, thereby executing the drive control (speed control) of the electric motor 21 for swiveling.

Additionally, the hybrid shovel related to the present embodiment includes an inclination sensor S1, a boom angle sensor S2, an arm angle sensor S3, a bucket angle sensor S4, a traveling rotation sensor S5A (right), and a traveling rotation sensor S5B (left), and the like, as sensors that detects the hybrid shovel's own operations.

The inclination sensor S1 is a sensor that detects inclination angles in biaxial directions (a front-rear direction and a left-right direction) with respect to a horizontal plane of the hybrid shovel. For example, arbitrary inclination sensors, such as a liquid-enclosed capacitance type inclination sensor, may be used for the inclination sensor S1. The detected inclination angle is transmitted to the controller 30.

The boom angle sensor S2 is provided at a supporting portion (joint) of the boom 4 in the upper swivel body 3, and detects the angle (boom angle) from the horizontal plane of the boom 4. For example, arbitrary angle sensors, such as a rotary potentiometer, may be used for the boom angle sensor S2, and the same applies to the arm angle sensor S3 and the bucket angle sensor S4 to be described below. The detected boom angle is transmitted to the controller 30.

The arm angle sensor S3 is provided at a supporting portion (joint) of the arm 5 in the boom 4, and detects the angle (arm angle) of the arm 5 with respect to the boom 4. The detected arm angle is transmitted to the controller 30.

The bucket angle sensor S4 is provided at a supporting portion (joint) of the bucket 6 in the arm. 5, and detects the angle (bucket angle) of the bucket 6 with respect to the arm 5. The detected bucket angle is transmitted to the controller 30.

The traveling rotation sensors S5A (right) and S5B (left) detect the rotating speeds of the hydraulic motor 1A (right) and the hydraulic motor 1B (left), respectively. For example, arbitrary rotation sensors, such as a magnetic type, may be used for the traveling rotation sensors S5A and S5B. The respective detected rotating speeds are transmitted to the controller 30.

In the configuration as above, the electric power generated by the motor generator 12 is supplied to the DC bus 110 of the power storage system 120 via the inverter 18, and is supplied to the capacitor 19 via the step-up/down converter 100. Additionally, the regenerative electric power generated by the electric motor 21 for swiveling through the regenerative operation is supplied to the DC bus 110 of the power storage system 120 via the inverter 20, and is supplied to the capacitor 19 via the step-up/down converter 100.

Figure 4:
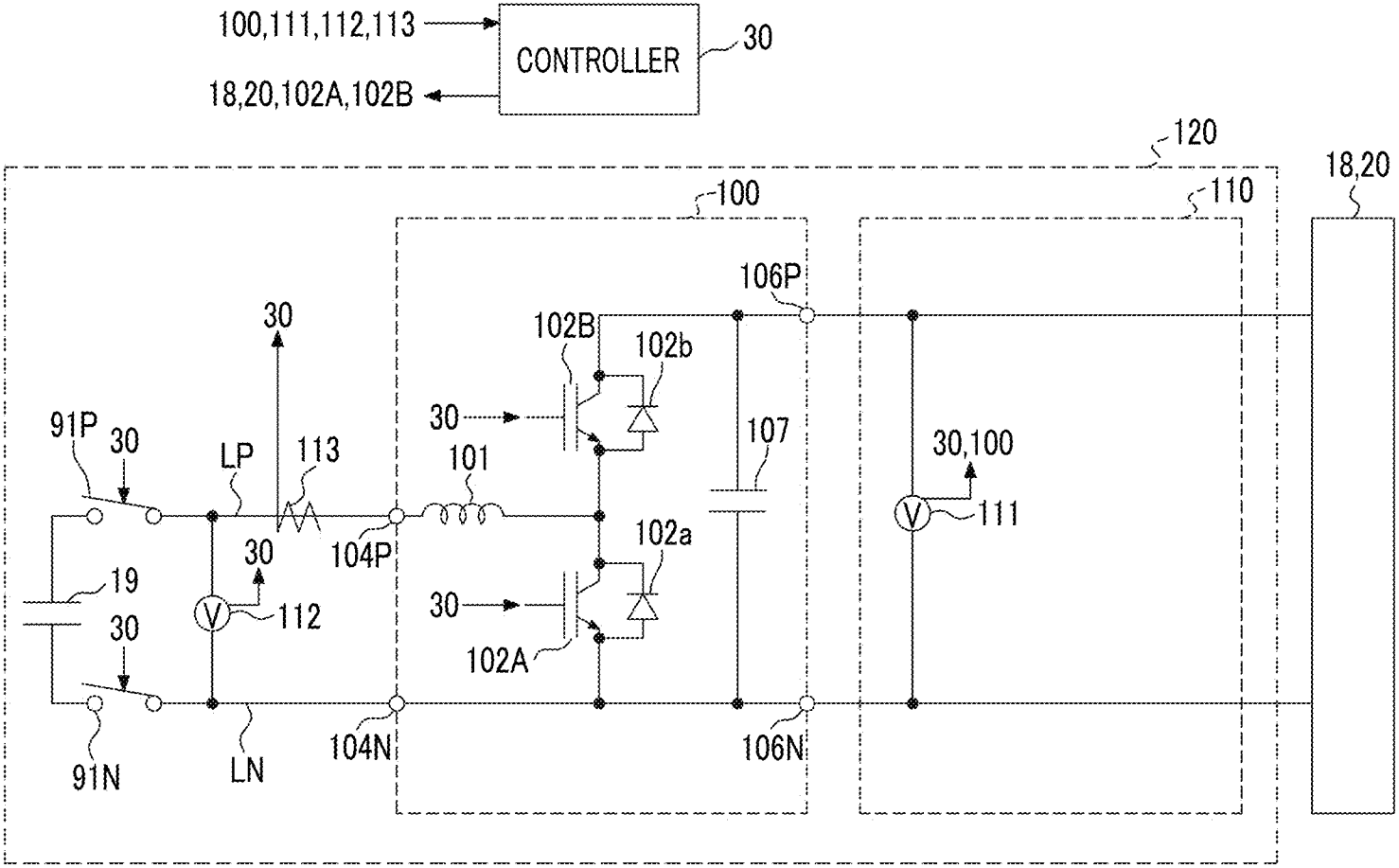
FIG. 4 is a circuit diagram of the power storage system of the hybrid shovel.

FIG. 4 is a circuit diagram of the power storage system 120. The step-up/down converter 100 includes a reactor 101, a step-up insulated gate bipolar transistor (IGBT) 102A, a step-down IGBT 102B, a pair of power source connecting terminals 104 for connecting the capacitor 19, a pair of output terminals 106 for connecting the inverters 18 and 20, and a smoothing capacitor 107 inserted in parallel into the pair of output terminals 106. The pair of output terminals 106 of the step-up/down converter 100 and the inverters 18 and 20 connects together by a DC bus 110.

One end of the reactor 101 is connected to a midpoint between the step-up IGBT 102A, and the step-down IGBT 102B, and the other end of the reactor is connected to a positive-electrode-side power source connecting terminal 104P. The reactor 101 is provided to supply an induced electromotive force generated with ON/OFF of the step-up IGBT 102A to the DC bus 110.

The step-up IGBT 102A and the step-down IGBT 102B are semiconductor elements (switching elements) capable of performing high-speed switching of large electric power. In the present embodiment, the step-up IGBT and the step-down IGBT are constituted of bipolar transistors in which a metal oxide semiconductor field effect transistor (MOSFET) is assembled into a gate portion. Also, the step-up IGBT 102A and the step-down IGBT 102B are driven by applying a PWM voltage to gate terminals by the controller 30. Additionally, diodes 102*a* and 102*b* that are rectifying devices are connected in parallel to the step-up IGBT 102A and the step-down IGBT 102B.

The capacitor 19 is a power storage device that performs transfer of electric power between the capacitor and the DC bus 110 via the step-up/down converter 100 and that is capable of performing charge and discharge. In the present embodiment, a lithium ion capacitor (LIC) is adopted as the capacitor 19. In addition, secondary batteries, such as an electric double layer capacitor (EDLC) and a lithium ion battery (LIB), and other types of power sources capable of performing transfer of electric power may be adopted instead of the lithium ion capacitor.

The pair of power source connecting terminals 104 and the pair of output terminals 106 have only to be terminals capable of connecting the capacitor 19 and the inverters 18 and 20. In addition, the capacitor voltage detecting unit 112 is connected between the pair of power source connecting terminals 104. Additionally, the DC bus voltage detecting unit 111 is connected between the pair of output terminals 106.

The capacitor voltage detecting unit 112 detects a capacitor voltage value Vcap that is a voltage between the terminals of the capacitor 19. Additionally, the DC bus voltage detecting unit 111 detects a DC bus voltage value Vdc that is the voltage of the DC bus 110. The smoothing capacitor 107 is inserted between a positive-electrode-side output terminal 106P and a negative-electrode-side output terminal 106N, and smoothes the DC bus voltage value Vdc.

The capacitor current detecting unit 113 is detection means for detecting the value of an electric current that flows to the capacitor 19, and includes a current detecting resistor in a positive electrode terminal (P terminal) side of the capacitor 19.

When the voltage of the DC bus 110 is stepped up to a value equal to or greater than the capacitor voltage value by the step-up/down converter 100, a PWM voltage is applied to the gate terminal of the step-up IGBT 102A. As a result, an induced electromotive force generated in the reactor 101 with ON/OFF of the step-up IGBT 102A is supplied to the DC bus 110 via the diode 102*b* connected in parallel to the step-down IGBT 102B. Accordingly, the voltage of DC bus 110 is stepped up. In addition, when the voltage of the DC bus 110 is stepped up to a voltage value less than the capacitor voltage value, the step-up/down converter 100 can move the electrical energy of the capacitor 19 to the DC bus 110 via the diode 102*b*.

When the voltage of the DC bus 110 is stepped down by the step-up/down converter 100, a PWM voltage is applied to the gate terminal of the step-down IGBT 102B. As a result, the regenerative electric power from the inverters 18 and 20 is supplied from the DC bus 110 via the step-down IGBT 102B to the capacitor 19. Accordingly, the electric power stored in the DC bus 110 is charged in the capacitor 19, and the voltage of the DC bus 110 is stepped down.

In addition, a drive unit (not illustrated) that generates a PWM signal that drives the step-up IGBT 102A is present between the controller 30 and the step-up IGBT 102A. This drive unit may be realized by either of an electronic circuit and an arithmetic processing unit. The same applied to the step-down IGBT 102B.

Additionally, in the present embodiment, a positive-electrode-side power supply line LP, which connects the positive electrode terminal of the capacitor 19 and the positive-electrode-side power source connecting terminal 104P of the step-up/down converter 100, is provided with a positive-electrode-side relay 91P serving as a relay. The positive-electrode-side relay 91P is brought into an ON (conduction) state by a conduction signal from the controller 30, and is brought into an OFF (cutoff) state by a cutoff signal. The controller 30 can bring the positive-electrode-side relay 91P into a cutoff state, thereby separating the capacitor 19 from the step-up/down converter 100.

Additionally, a negative-electrode-side power supply line LN, which connects a negative electrode terminal of the capacitor 19 and a negative-electrode-side power source connecting terminal 104N of the step-up/down converter 100, is provided with a negative-electrode-side relay 91N. The negative-electrode-side relay 91N, similar to the positive-electrode-side relay 91P, is brought into an ON (conduction) state by a conduction signal from the controller 30, and is brought into an OFF (cutoff) state by a cutoff signal. The controller 30 can make the negative-electrode-side relay 91N into a cutoff state, thereby separating the capacitor 19 from the step-up/down converter 100.

In addition, the controller 30 may control the positive-electrode-side relay 91P and the negative-electrode-side relay 91N as a set of relays, and may simultaneously bring both of the relays into a cutoff state so as to separate the capacitor 19 from the step-up/down converter 100.

Next, means (swiveling stopped state holding means) for holding the swiveling stopped state of the upper swivel body 3 of the hybrid shovel related to the present embodiment will be described as a premise of the switching control of performing the actuation/release of the mechanical brake 23 by the controller 30 to be described below.

In the hybrid shovel related to the present embodiment, when the swiveling manipulation (the operation for driving the swiveling mechanism 2 (electric motor 21 for swiveling)) of the manipulating device 26 is not performed, it is necessary to hold the swiveling stopped state of the upper swivel body 3. Therefore, the hybrid shovel related to the present embodiment has two of the mechanical brake 23 and the servo lock control (hereinafter referred to as servo lock control) of the electric motor 21 for swiveling, as means for holding the swiveling stopped state of the upper swivel body 3.

The mechanical brake 23, as described above, mechanically stops the rotating shaft 21A of the electric motor 21 for swiveling according to a frictional force between the brake disk and the brake plate. This holds the stopped state of the upper swivel body 3. In this way, since the mechanical brake 23 holds the swiveling stopped state of the upper swivel body 3 according to the frictional force, energy is not consumed during the actuation of the mechanical brake.

Meanwhile, since there is a concern that wear may be promoted due to slip or the like in a frictional surface in a situation that a large external force acts on the upper swivel body 3 or a large external force fluctuations occurs in the upper swivel body, it is preferable that the mechanical brake 23 is not actuated (released).

The servo lock control is the control executed by the controller 30 in order to generate the torque for holding the swiveling stopped state from the electric motor 21 for swiveling, and the swiveling stopped state of the upper swivel body 3 is held by the holding torque. The controller 30 receives the rotational position and the rotating speed of the electric motor 21 for swiveling detected by the resolver 22, performs the feedback control regarding the rotational position and the rotating speed so that the rotational position is held, and generates a torque command (a command value for the torque which the electric motor 21 for swiveling is made to generate). Then, the controller 30 drives the inverter 20 according to the generated torque command, and generates the holding torque for holding the position of the upper swivel body 3 from the electric motor 21 for swiveling. The servo lock control can make the holding torque generated from the electric motor 21 for swiveling so as to hold the position of the upper swivel body 3 even in a situation where a large external force act on the upper swivel body 3 or a large external force fluctuation occurs in the upper swivel body. Therefore, in the situation concerned, the swiveling stopped state of the upper swivel body 3 can be held instead of the mechanical brake 23.

Meanwhile, the servo lock control is required to supply electric power to the electric motor 21 for swiveling in order to hold the swiveling stopped state of the upper swivel body 3, and consumes energy when the swiveling stopped state of the upper swivel body 3 is held.

In addition, the servo lock control in the present example sets the speed command of the electric motor for swiveling to a zero value, thereby holding the swivel body so as not to swivel. In this case, when an external force to rotate the swivel body is applied to the swivel body of the shovel, the torque that opposes the external force is output from the electric motor for swiveling, and tends to maintain the speed of the swivel body at 0. Therefore, according to the posture or the operation state of the shovel, the electric motor for swiveling outputs a relatively large torque even in the servo lock control state. If the state concerned lasts for a long time, there is a concern that the electric motor 21 for swiveling may be overloaded. Therefore, it is preferable that the holding of the upper swivel body 3 through the servo lock control is not used for a long time.

Therefore, it is preferable that the swiveling stopped state of the upper swivel body 3 is held by the mechanical brake 23 except a situation where a large external force acts on the upper swivel body 3 and a large external force fluctuation occurs in the upper swivel body.

Next, the switching control of performing the actuation/release of the mechanical brake 23 using the controller 30 will be described on the premise that the mechanical brake 23 serving as the above-described swiveling stopped state holding means and the servo lock control are provided. In addition, the following description are about a situation where it is necessary to hold the swiveling stopped state of the upper swivel body 3, and is premised on the swiveling manipulation of the manipulating device 26 not being performed.

The controller 30 holds the swiveling stopped state of the upper swivel body 3 through the servo lock control of the mechanical brake 23 or the electric motor 21 for swiveling. In this case, in the present embodiment, whether any one of the actuation of the mechanical brake 23 and the servo lock control of the electric motor 21 for swiveling is selected is determined on the basis of information on the discharge pressure of the main pump 14 input from the discharge pressure sensor 14*b* (discharge pressure signal). That is, the controller 30 executes the switching control of performing the actuation/release of the mechanical brake 23, on the basis of the information on the discharge pressure of the main pump 14 detected by the discharge pressure sensor 14*b*.

First, an example of the switching control of the mechanical brake 23 by the controller 30 will be described.

As a basic way of thinking, the mechanical brake has only to be used when an external force applied to the swivel body or an external force fluctuation is small, and the servo lock control has only to be performed when an external force is large or an external force fluctuation is large. Whether any one is to be used can be determined by detecting the operation situation, driving information, or the like of the shovel or on the basis of information about the shovel, such as a manipulation command. An example is illustrated below.

In the present example, the controller 30 actuates the mechanical brake 23 when the discharge pressure P of the main pump 14 detected by the discharge pressure sensor 14*b* is smaller than a predetermined pressure value Pth. On the other hand, the controller 30 releases the mechanical brake 23 and holds the swiveling stopped state of the upper swivel body 3 through the servo lock control when the discharge pressure P of the main pump 14 is equal to or greater than the predetermined pressure value Pth.

This is because it is assumed that, when the discharge pressure of the main pump 14 is relatively low, the hydraulic actuators are driven under a light load, and there is a low possibility that such a large external force that wear of the mechanical brake 23 is promoted via the respective work elements acts on the upper swivel body 3.

Subsequently, another example of the switching control of the mechanical brake 23 by the controller 30 will be described.

In the present example, the controller 30 calculates the amount dP of fluctuation of the discharge pressure within a predetermined time, on the basis of the discharge pressure P of the main pump 14 detected by the discharge pressure sensor 14*b*. Also, the controller actuates the mechanical brake 23 when the amount dP of fluctuation is smaller than a predetermined fluctuation value dPth. On the other hand, the controller 30 releases the mechanical brake 23 and holds the swiveling stopped state of the upper swivel body 3 through the servo lock control when the amount dP of fluctuation is equal to or greater than the predetermined fluctuation value dPth.

This is because it is assumed that, when the amount of fluctuation of the discharge pressure of the main pump 14 is relatively low, there is a low possibility that such a large external force that wear of the mechanical brake 23 is promoted via the respective work elements acts on the upper swivel body 3 even if the hydraulic actuators are driven under a high load.

In addition, the above-described one example and other example may be combined. That is, the controller 30 may actuate the mechanical brake 23 when the discharge pressure P of the main pump 14 is smaller than the predetermined pressure value Pth or when the amount dP of fluctuation of the discharge pressure within a predetermined time is smaller than the predetermined fluctuation value dPth. On the other hand, the controller 30 may release the mechanical brake 23 and may hold the swiveling stopped state of the upper swivel body 3 through the servo lock control when the discharge pressure P of the main pump 14 is equal to or greater than the predetermined pressure value Pth and when the amount dP of fluctuation of the discharge pressure within a predetermined time is equal to or greater than the predetermined fluctuation value dPth.

In this way, the controller 30 can actuate the mechanical brake 23 on the basis of the information on the discharge pressure of the main pump 14, even in a case where the operation of driving the hydraulic actuators is performed. Therefore, it is possible to reduce frequency at which the servo lock control is used, and a decline in the rate of energy consumption resulting from the servo lock control and generation of overload of the electric motor 21 for swiveling caused by the servo lock control can be suppressed.

Next, an example of the operating state of the hybrid shovel capable of actuating the mechanical brake 23 will be described on the basis of one example and another example of the switching control of performing the actuation/release of the mechanical brake 23 by the above-described controller 30.

FIG. 5 is a table illustrating operation examples of the hybrid shovel capable of actuating the mechanical brake 23, and drive states of the hydraulic actuators in the respective operation examples. Respective columns of the table show five operating states (a scraping operation, a horizontal pulling and leveling operation, a hydraulic oil warm-up operation, a direction change operation, an excavation operation) from the left. Additionally, respective rows show the operating states of the boom cylinder 7, the arm cylinder 8, the bucket cylinder 9, the hydraulic motor 1A (right), and the hydraulic motor 1B (left) from the top.

In addition, the excavation operation among the five operating states will be described by reference for the comparison with the other four operating states. That is, as illustrated in FIG. 5, in the excavation operation, the boom cylinder 7, the arm cylinder 8, and the bucket cylinder 9 are driven under a high load. Therefore, the discharge pressure of the main pump 14 becomes relatively large, and the fluctuation of the discharge pressure becomes relatively large. Therefore, the mechanical brake 23 is released during the excavation operation, and the swiveling stopped state of the upper swivel body 3 is held through the servo lock control.

First, the scraping operation will be described as an operation example of the hybrid shovel capable of actuating the mechanical brake 23.

The scraping operation is the operation for dropping mud adhering to a crawler of the lower traveling body 1 during a traveling operation is repeated. In addition, the mud adhering to the crawler of the lower traveling body 1 becomes a hindrance to a smooth traveling operation if the amount of adhesion becomes too much. Additionally, since the mud that has adhered to the crawler becomes resistance during traveling, loads to the hydraulic motors 1A and 1B become large. Therefore, it is preferable that the scraping operation is periodically performed.

Figure 6:
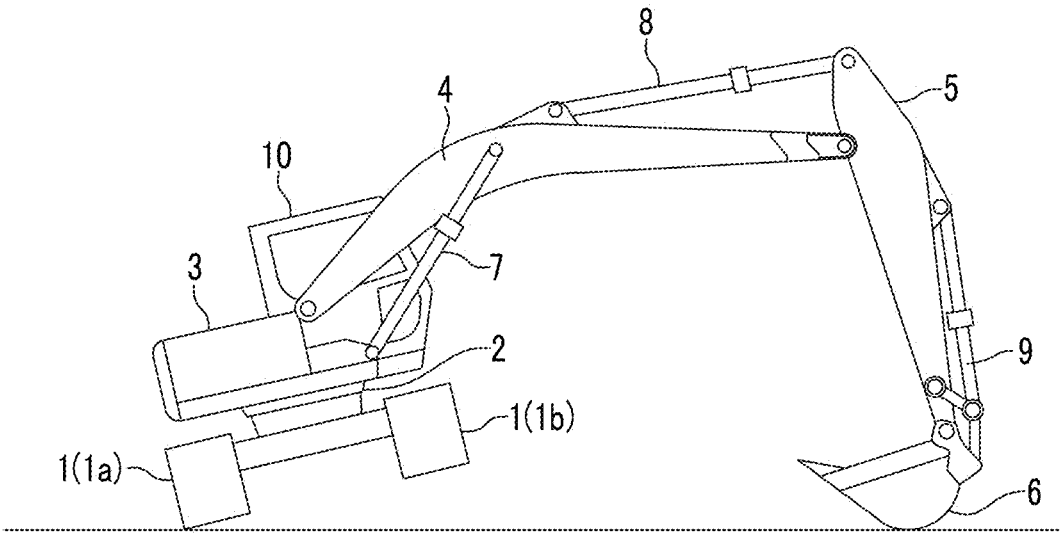
FIG. 6 is a view illustrating a state where a hybrid shovel body is jacked up when the scraping work of a crawler of a lower traveling body is performed.

The scraping operation, as illustrated in FIG. 6, jacks up the hybrid shovel, and floats at least one of the left and right crawlers la (right) and 1*b* (left) of the lower traveling body 1 from the ground. In addition, in FIG. 6, the hybrid shovel is jacked up so that the crawler 1*b* (left) floats from the ground.

Specifically, an operator manipulates the manipulating device 26 and swivels the upper swivel body 3 by 90° leftward (or rightward) from a state (state of FIG. 1) in which the upper swivel bodies 3 is directed to a straight-ahead direction. Thereafter, the manipulating device 26 is manipulated to perform boom lowering, arm closing, or the like, and the bucket 9 is grounded. Then, in that state, the left crawler 1*b* (or right crawler 1*a*) is further floated in the air from the ground by continuing boom lowering, arm closing, or the like.

The mud adhering to the crawler 1*b* (or the crawler 1*a*) is dropped to the ground by driving and idling a crawler (the left crawler 1*b* in FIG. 6) that has been floated in a state where the hybrid shovel is jacked up.

During such a scraping operation, as illustrated in FIG. 5, the boom cylinder 7, the arm cylinder 8, and the bucket cylinder 9 are not driven. Then, only the hydraulic motor 1B (left) corresponding to the floated crawler 1*b* out of the hydraulic motors 1A and 1B is driven. Additionally, since the crawler 1*b* is in the idling state, the hydraulic motor 1B (left) is driven under a light load. That is, the discharge pressure of the main pump 14 for supplying hydraulic oil to the hydraulic actuators becomes relatively small during the scraping operation.

Additionally, since only the crawler 1*b* is idling during a specific scraping operation, there is a low possibility that such a large external force that wear of the mechanical brake 23 is promoted acts on the upper swivel body 3.

Hence, the controller 30 can set the predetermined pressure value Pth to be greater than the discharge pressure of the main pump 14 assumed during the scraping operation in advance, thereby actuating the mechanical brake 23 during the scraping operation.

In addition, when the jack-up as illustrated in FIG. 6 is performed in a state where the upper swivel body 3 is swiveled to be greater than or smaller than 90 degrees from a state where the upper swivel body 3 is directed to the straight-ahead direction, there is a concern that an imbalanced state where a moment that swivels the upper swivel body 3 always acts may be brought about. If the servo lock control is executed in such the state, the electric motor 21 for swiveling always needs to continue generating a holding torque that cancels out a torque with which the upper swivel body 3 tends to swivel. Then, there is a concern that, as the scraping operation proceeds, the electric motor 21 for swiveling may be brought into an overload state, and it may be impossible to drive the electric motor 21 for swiveling. However, in the present example, a situation where the electric motor 21 for swiveling falls into an overload state by actuating the mechanical brake 23 during the scraping operation can be suppressed.

Subsequently, the horizontal pulling and leveling operation will be described as an operation example of the hybrid shovel capable of actuating the mechanical brake 23.

The horizontal pulling and leveling operation is the operation of performing leveling by grounding a tip portion of the bucket 9 on the surface of the earth and performing a horizontal pulling operation while maintaining the height of the tip portion of the bucket 9, in a state where the boom 4 and the arm 5 are extended forward.

Specifically, the operator performs the operation of performing the horizontal pulling and leveling operation by grounding the tip portion of the bucket 9 on the surface of the earth and gradually and simultaneously performing boom raising, arm closing, and bucket opening in a state where the boom 4 and the arm 5 are extended forward through the operation in the manipulating device 26.

In such horizontal pulling and leveling operation, as illustrated in FIG. 5, the hydraulic motors 1A and 1B are not driven. Additionally, the boom cylinder 7, the arm cylinder 8, and the bucket cylinder 9 are driven under a low load, respectively. That is, the discharge pressure of the main pump 14 for supplying hydraulic oil to the hydraulic actuators becomes relatively small during the horizontal pulling and leveling operation.

Additionally, during a specific horizontal pulling and leveling operation, it is assumed that only a relatively small external force when the bucket 6 smoothes a small step on the surface of the earth is exerted, and there is a low possibility that such a large external force that wear of the mechanical brake 23 is promoted acts on the upper swivel body 3.

Hence, the controller 30 can set the predetermined pressure value Pth to be greater than the discharge pressure of the main pump 14 assumed during the horizontal pulling and leveling operation in advance, thereby actuating the mechanical brake 23 during the horizontal pulling and leveling operation.

Subsequently, the hydraulic oil warm-up operation will be described as an operation example of the hybrid shovel capable of actuating the mechanical brake 23.

The hydraulic oil warm-up operation is the operation that is performed to warm up the hydraulic oil for driving the hydraulic actuators in an early stage, in winter, cold regions, or the like where temperature is low.

Specifically, the operator manipulates the manipulating device 26, and continues further manipulating the manipulating device 26 in a state where the bucket cylinder 9 is driven up to a stroke end. More specifically, the bucket 6 is completely closed, and the manipulating device 26 continues being manipulated in a direction in which the bucket 6 is further closed in the close state. Additionally, the bucket 6 is completely opened, and the manipulating device 26 continues being manipulated in a direction in which the bucket 6 is further opened in the close state. Accordingly, the hydraulic oil can be relieved, and the hydraulic oil can be warmed up with the quantity of heat generated due to the relief.

In such a hydraulic oil warm-up operation, as illustrated in FIG. 5, only a hydraulic actuator (bucket cylinder 9) used to warm up the hydraulic oil is driven. In this case, since the bucket cylinder 9 is driven to the stroke end, and the manipulation in the manipulating device 26 further continues, the bucket cylinder is in the state of being driven under a high load. That is, the discharge pressure of the main pump 14 for supplying hydraulic oil to the hydraulic actuators becomes relatively large during the hydraulic oil warm-up operation. On the other hand, since the main pump 14 only supplies the hydraulic oil to the bucket cylinder 9 driven up to the stroke end, the amount of fluctuation of the discharge pressure of the main pump 14 becomes relatively small.

Additionally, during a specific hydraulic oil warm-up operation, bucket closing or bucket opening is only performed, and there a low possibility that such a large external force fluctuation that wear of the mechanical brake 23 is promoted occurs in the upper swivel body 3.

Therefore, the controller 30 can set the predetermined fluctuation value dPth to be greater than the amount of fluctuation of the discharge pressure of the main pump 14 within a predetermined time, which is assumed during the hydraulic oil warm-up operation, in advance, thereby actuating the mechanical brake 23 during the hydraulic oil warm-up operation.

Subsequently, the direction change operation will be described as an operation example of the hybrid shovel capable of actuating the mechanical brake 23.

The direction change operation is the operation of changing (converting) the straight-ahead direction of the hybrid shovel. In addition, the direction change operation in the present example shows a case where the radius of rotation is relatively small.

Specifically, the straight-ahead direction of the hybrid shovel is changed by providing a difference between the rotating speed of the hydraulic motor 1A (right) and the rotating speed of the hydraulic motor 1B (left). In the present example, an example in which only one hydraulic motor 1A (or the hydraulic motor 1B) out of the hydraulic motors 1A and 1B is driven, and the direction thereof is changed (turned) leftward (or rightward) on that spot.

In such a direction change operation, as illustrated in FIG. 5, only the hydraulic motor 1A is driven. In this case, the hydraulic motor 1A is in the state of being driven under a high load in order to turn the hybrid shovel on that spot. That is, the discharge pressure of the main pump 14 for supplying hydraulic oil to the hydraulic actuators becomes relatively large during the direction change operation. On the other hand, since the direction change operation has little fluctuation in the operating speed during this operation and is often executed as a substantially regular operation, the amount of fluctuation of the discharge pressure of a main pump 14 becomes relatively small.

Additionally, during a specific direction change operation, a direction change as a substantially regular operation is performed. Therefore, there a low possibility that such a large external force fluctuation that wear of the mechanical brake 23 is promoted occurs in the upper swivel body 3.

Therefore, the controller 30 can set the predetermined fluctuation value dPth to be greater than the amount of fluctuation of the discharge pressure of the main pump 14 within a predetermined time, which is assumed during the direction change operation, in advance, thereby actuating the mechanical brake 23 during the direction change operation.

In addition, even if both of the hydraulic motors 1A and 1B are driven to perform a direction change with a relatively small radius of rotation, a direction change as a substantially regular operation is performed. Thus, the controller 30 may actuate the mechanical brake 23 similarly. On the other hand, when a direction change is performed with a relatively large radius of rotation (when a difference between the rotating speed of the hydraulic motors 1A and 1B is small), traveling is performed while the direction change is performed. Therefore, there is a high possibility that a relatively large external force fluctuation occurs in the upper swivel body 3. Additionally, during traveling, there is a high possibility that the amount of fluctuation of the discharge pressure of the main pump 14 also becomes large due to the action of the external force onto the lower traveling body 1 or the like. Therefore, the controller 30 may release the mechanical brake 23 so as to hold the swiveling stopped state of the upper swivel body 3 through the servo lock control.

Additionally, the operations of the hybrid shovel capable of actuating the mechanical brake 23 are not limited to the above-described operations. That is, arbitrary operations, which are performed in a state where the discharge pressure of the main pump 14 is relatively small (the discharge pressure P of the main pump 14 is smaller than the predetermined pressure value Pth), may be included in the operations of the hybrid shovel capable of actuating the mechanical brake 23. Additionally, arbitrary operations, which are performed in a state where the amount of fluctuation of the discharge pressure of the main pump 14 within a predetermined time is relatively small (the amount dP of fluctuation of the discharge pressure of the main pump 14 within the predetermined time is smaller than the predetermined fluctuation value dPth), may be included in the operations of the hybrid shovel capable of actuating the mechanical brake 23.

Although the embodiments for carrying out invention have been described above in detail, the invention is not limited to the relevant specific embodiments, and various alterations and changes can be made within the scope of the invention described in the claims.

For example, the controller 30 may specify the operations (the scraping operation, the horizontal pulling and leveling operation, the hydraulic oil warm-up operation, the direction change operation, and the like) of the hybrid shovel capable of actuating the above-described mechanical brake 23, and may execute the switching control of the actuation/release of the mechanical brake 23.

Specifically, the operations of the hybrid shovel may be specified on the basis of information on the manipulation input of the manipulating device 26 for manipulating the hydraulic actuators, in addition to the information on the discharge pressure of the above-described main pump 14. As the information on the manipulation input of the manipulating device 26, an electrical signal input from the pressure sensor 29 to the controller 30 (corresponding to the pilot pressure generated by the manipulating device 26) can be used.

For example, when the manipulation of driving any one of the hydraulic motors 1A and 1B is performed on the manipulating device 26 and the discharge pressure P of the main pump 14 is smaller than the predetermined pressure value Pth, the scraping operation may be specified to be performed. In addition, even in a case where it is only known that at least one of the hydraulic motors 1A and 1B is driven even if the electrical signal from the pressure sensor 29 is used, the scraping operation can be specified by combining the conditions that the discharge pressure P of the main pump 14 is smaller than the predetermined pressure value Pth. That is, a state where the discharge pressure of the main pump 14 is relatively low irrespective of whether at least one of the hydraulic motors 1A and 1B is driving can be assumed to be a state where the lower traveling body 1 idles, and the operating state can be specified to be the scraping operation.

Additionally, the operations of the hybrid shovel may be specified on the basis of the detection values of the boom angle sensor S2, the arm angle sensor S3, the bucket angle sensor S4, the traveling rotation sensor S5A (right), and the traveling rotation sensor S5B (left) in addition to the information on the discharge pressure of the above-described main pump 14. That is, the operations of the hybrid shovel may be estimated through arithmetic processing based on the boom angle, the arm angle, and the bucket angle detected by the boom angle sensor S2, the arm angle sensor S3, the bucket angle sensor S4, and the traveling rotation sensors S5A and S5B, and the rotating speeds of the hydraulic motors 1A and 1B. Also, the operations of the hybrid shovel may be specified by combining an estimated operation with the information on the discharge pressure. Additionally, when the operations of the hybrid shovel are estimated on the basis of the detection values of the boom angle sensor S2, the arm angle sensor S3, the bucket angle sensor S4, and the traveling rotation sensors S5A and S5B, the detection value of the inclination sensor S1 may be taken into consideration.

For example, when the horizontal pulling operation is estimated through the arithmetic processing based on the detected boom angle, arm angle, and bucket angle, and the discharge pressure P of the main pump 14 is smaller than the predetermined pressure value Pth, the horizontal pulling and leveling operation may be specified to be performed.

Additionally, when the direction change operation is estimated through the arithmetic processing based on the detected rotating speeds of the hydraulic motors 1A and 1B and the amount dP of fluctuation of the discharge pressure of the main pump 14 within a predetermined time is smaller than the predetermined fluctuation value dPth, the direction change operation with a relatively small radius of rotation may be specified to be performed.

Although the operations of the hybrid shovel are specified on the basis of the information on the discharge pressure of the main pump above, the mechanical brake may be actuated by detecting the operations of the shovel and by specifying the operations on the basis of the information of a manipulating lever or on the basis of secondary information or the like based on these kinds of information.

It should be understood that the invention is not limited to the above-described embodiment, but may be modified into various forms on the basis of the spirit of the invention. Additionally, the modifications are included in the scope of the invention.

What is claimed is:

1. A shovel comprising:

a lower traveling body;

an upper swivel body that is mounted on the lower traveling body;

an electric motor configured to swivel the upper swivel body relative to the lower traveling body;

a mechanical brake configured to hold the upper swivel body in a swiveling stopped state by a friction force;

a manipulating device connected to a control valve for actuating a spool valve;

a pilot pressure sensor configured to convert pilot pressure generated by the manipulating device into an electrical signal;

a hydraulic pump that discharges hydraulic oil;

a hydraulic actuator that is driven by a portion of the hydraulic oil discharged by the hydraulic pump and provided via the spool valve;

a discharge pressure sensor that detects discharge pressure of the hydraulic pump; and a controller configured to receive the electrical signal, the controller further configured to hold the upper swivel body in the swiveling stopped state by executing one of (i) applying the friction force of the mechanical brake and (ii) outputting a torque from the electric motor responsive to determining that a magnitude of a fluctuation value of the discharge pressure of the hydraulic pump detected by the discharge pressure sensor is smaller than a predetermined fluctuation value, and executing the other of (i) applying the friction force of the mechanical brake and (ii) outputting the torque from the electric motor responsive to determining that the magnitude of the fluctuation value of the discharge pressure of the hydraulic pump detected by the discharge pressure sensor is not smaller than the predetermined fluctuation value.

2. The shovel according to claim 1, wherein the controller is coupled to a manipulating device to receive manipulating information for manipulating the electric motor and the hydraulic actuator, the controller further configured to cause the friction force of the mechanical brake to be applied but cause the electric motor to not output the torque responsive to the discharge pressure detected by the discharge pressure sensor being smaller than a predetermined pressure value.

3. The shovel according to claim 1, wherein the controller is coupled to a manipulating device to receive manipulating information for manipulating the electric motor and the hydraulic actuator, the controller further configured to cause the friction force of the mechanical brake to be applied but cause the electric motor to not output the torque responsive to fluctuation of the discharge pressure detected by the discharge pressure sensor being smaller than the predetermined fluctuation value.

4. The shovel according to claim 1, wherein the controller is coupled to a manipulating device to receive manipulating information for manipulating the electric motor and the hydraulic actuator, the controller is further configured to cause the electric motor to output the torque but cause the friction force of the mechanical brake not to be applied responsive to the discharge pressure of the hydraulic pump detected by the discharge pressure sensor being larger than a predetermined pressure value.

5. The shovel according to claim 1, wherein the controller is coupled to a manipulating device to receive manipulating information for manipulating the electric motor and the hydraulic actuator, the controller further configured to cause the electric motor to output the torque but cause the friction force of the mechanical brake not to be applied responsive to fluctuation of the discharge pressure of the hydraulic pump detected by the discharge pressure sensor being larger than the predetermined fluctuation value.

6. The shovel according to claim 1, wherein the controller is configured to release the mechanical brake and cause the electric motor to output the torque responsive to determining that the discharge pressure of the hydraulic pump detected by the discharge pressure sensor is larger than a predetermined pressure value or fluctuation of the discharge pressure of the hydraulic pump is larger than the predetermined fluctuation value in a state where the friction force of the mechanical brake is applied to hold the upper swivel body in the swiveling stopped state.

7. The shovel according to claim 1, wherein the controller is configured to cause the electric motor not to output the torque and apply the friction force by the mechanical brake responsive to determining that the discharge pressure of the hydraulic pump detected by the discharge pressure sensor is larger than a predetermined pressure value or fluctuation of the discharge pressure of the hydraulic pump is larger than the predetermined fluctuation value in a state where the torque is output from the electric motor to hold the upper swivel body in the swiveling stopped state.

8. The shovel according to claim 1, wherein the controller is configured to, based on information of the discharge pressure of the hydraulic pump and manipulation information received from a manipulating device, detect at least one of a scraping operation, a horizontal pulling and leveling operation, a hydraulic oil warm-up operation, and a direction change operation.

9. The shovel according to claim 8, further comprising:

work elements including a boom, an arm and a bucket; and an angle sensor configured to detect angles of the boom, the arm, and the bucket, wherein the controller is configured to, based on the information of the discharge pressure of the hydraulic pump and the detected angles of the boom, the arm, and the bucket, detect at least one of the scraping operation, the horizontal pulling and leveling operation, the hydraulic oil warm-up operation, and the direction change operation.

10. The shovel according to claim 1, wherein the hydraulic pump is connected to the control valve via a hydraulic line, the hydraulic oil discharged from the hydraulic pump sequentially passes through the hydraulic line, the control valve and the hydraulic actuator, and the discharge pressure sensor is provided in the hydraulic line.

* * * * *